US009133405B2

(12) United States Patent
Abughazaleh

(10) Patent No.: US 9,133,405 B2
(45) Date of Patent: Sep. 15, 2015

(54) SYSTEMS AND METHODS FOR GASIFYING A FEEDSTOCK

(75) Inventor: John Abughazaleh, Sugar Land, TX (US)

(73) Assignee: KELLOGG BROWN & ROOT LLC, Houston, TX (US)

( * ) Notice: Subject to any disclaimer, the term of this patent is extended or adjusted under 35 U.S.C. 154(b) by 958 days.

(21) Appl. No.: 12/982,318

(22) Filed: Dec. 30, 2010

(65) Prior Publication Data

US 2012/0167463 A1 Jul. 5, 2012

(51) Int. Cl.

| | |
|---|---|
| ***C10J 3/54*** | (2006.01) |
| ***C10J 3/56*** | (2006.01) |
| ***C10J 3/86*** | (2006.01) |
| *C10K 1/00* | (2006.01) |
| *C10K 1/02* | (2006.01) |
| *C10K 3/04* | (2006.01) |

(52) U.S. Cl.

CPC .... *C10J 3/54* (2013.01); *C10J 3/56* (2013.01); *C10J 3/86* (2013.01); *C10J 2300/0906* (2013.01); *C10J 2300/0996* (2013.01); *C10J 2300/164* (2013.01); *C10J 2300/165* (2013.01); *C10J 2300/1631* (2013.01); *C10J 2300/1656* (2013.01); *C10J 2300/1678* (2013.01); *C10J 2300/1807* (2013.01); *C10K 1/003* (2013.01); *C10K 1/02* (2013.01); *C10K 3/04* (2013.01)

(58) Field of Classification Search

CPC ..... C10J 3/12; C10J 2300/0983; C10J 2300/0996; C10J 2300/0993; C10J 2300/1807

USPC ..... 48/197 R

See application file for complete search history.

(56) References Cited

U.S. PATENT DOCUMENTS

| | | | | |
|---|---|---|---|---|
| 4,199,327 | A | 4/1980 | Hempill | |
| 4,230,556 | A | 10/1980 | Carr et al. | |
| 4,244,706 | A | 1/1981 | Forney et al. | |
| 4,257,806 | A | 3/1981 | Fujita et al. | |
| 4,325,709 | A | 4/1982 | Gohler et al. | |
| 4,391,611 | A | 7/1983 | Haldipur et al. | |
| 4,493,636 | A | 1/1985 | Haldipur et al. | |
| 4,765,781 | A | 8/1988 | Wilks et al. | |
| 4,867,756 | A * | 9/1989 | Patel | 48/197 R |
| 5,170,727 | A | 12/1992 | Nielsen | |

(Continued)

FOREIGN PATENT DOCUMENTS

WO WO 2004065847 A2 8/2004

OTHER PUBLICATIONS

Maurstad, Ola "An Overview of Coal based Integrated Gasification Combined Cycle (IGCC)Technology," Massachusetts Institute for Technology—Laboratory for Energy and the Environment, Sep. 2005, MIT LFEE 2005-002 WP, pp. 1-36.

"PERP 03/04S11," Coal Gasification Technologies, Nexant Chem Systems, Jan. 2005, pp. 1-46.

Barker, et al., "Pressure feeder for powered coal or other finely divided solids," I & EC, 43(5), p. 1204-1209.

(Continued)

*Primary Examiner* — Matthew Merkling
(74) *Attorney, Agent, or Firm* — Gary M. Machetta

(57) ABSTRACT

Systems and methods for gasifying a feedstock are provided. The method can include combining one or more feedstocks and one or more solid components in a treatment zone to provide a treated feedstock. At least a portion of the treated feedstock can be introduced to a reaction zone of a gasifier. The one or more solid components can have an average density and an average cross-sectional size that adjusts at least one of an average density of solids within a solids bed of the gasifier and an average cross-sectional size of the solids within the solids bed of the gasifier.

15 Claims, 3 Drawing Sheets

(56) References Cited

U.S. PATENT DOCUMENTS

| | | | | |
|---|---|---|---|---|
| 5,281,349 | A | 1/1994 | Okazaki et al. | |
| 5,361,513 | A | 11/1994 | Woessner | |
| 5,392,594 | A | 2/1995 | Moore et al. | |
| 5,423,894 | A | 6/1995 | Child et al. | |
| 5,447,702 | A | 9/1995 | Campbell et al. | |
| 5,560,900 | A | 10/1996 | Gbordzoe et al. | |
| 5,561,412 | A | 10/1996 | Novak et al. | |
| 5,578,093 | A | 11/1996 | Campbell et al. | |
| 5,655,466 | A | 8/1997 | Hulkkonen et al. | |
| 5,685,138 | A | 11/1997 | Rao et al. | |
| 5,713,312 | A | 2/1998 | Waryasz | |
| 5,953,899 | A | 9/1999 | Rao et al. | |
| 6,054,043 | A | 4/2000 | Simpson | |
| 6,312,482 | B1 | 11/2001 | James et al. | |
| 6,488,728 | B1 | 12/2002 | Rollinger | |
| 6,610,112 | B1 | 8/2003 | Klock et al. | |
| 6,676,716 | B2 | 1/2004 | Fujimura et al. | |
| 6,802,178 | B2 | 10/2004 | Sprouse et al. | |
| 6,824,575 | B1 | 11/2004 | Otomo et al. | |
| 6,966,190 | B2 | 11/2005 | Wylie | |
| 7,638,070 | B2 | 12/2009 | Johnson et al. | |
| 7,722,690 | B2 | 5/2010 | Shires et al. | |
| 7,749,290 | B2 | 7/2010 | Wallace | |
| 2002/0077512 | A1 | 6/2002 | Tendick et al. | |
| 2003/0041518 | A1 | 3/2003 | Wallace et al. | |
| 2003/0046868 | A1 | 3/2003 | Lewis | |
| 2003/0131582 | A1 | 7/2003 | Anderson et al. | |
| 2004/0182000 | A1 | 9/2004 | Mansour et al. | |
| 2004/0221583 | A1 | 11/2004 | Wylie | |
| 2005/0166810 | A1* | 8/2005 | Gnedenko et al. | 110/342 |
| 2005/0167333 | A1 | 8/2005 | McCall et al. | |
| 2006/0096298 | A1 | 5/2006 | Barnicki et al. | |
| 2006/0130719 | A1 | 6/2006 | Morin et al. | |
| 2006/0149423 | A1 | 7/2006 | Barnicki et al. | |
| 2006/0248791 | A1 | 11/2006 | Hogsett et al. | |
| 2007/0178035 | A1 | 8/2007 | White et al. | |
| 2008/0081844 | A1 | 4/2008 | Shires et al. | |
| 2008/0155899 | A1 | 7/2008 | Ramamurthy | |
| 2009/0151250 | A1 | 6/2009 | Agrawal | |
| 2009/0188165 | A1* | 7/2009 | Ariyapadi et al. | 48/210 |

OTHER PUBLICATIONS

Phillips, J., "Different Types of Gasifiers and Their Integration with Gas Turbines", Charlotte, NC.

Alessi, P., et al., "Particle production of steroid drugs using supercritical fluid processing," I&EC Res., 35(12), p. 4718-4726.

Booras, G., et al., "Pulverized Coal and IGCC Plant Cost and Performance Estimates," Electronic Power Research Institute, Gasification Technologies Conference, Washington DC, Oct. 3-6, 2004.

Camozzi, D. et al., "ENI Refining and Marketing Sannazzaro Gasification Plant Project Update and Start Up Experience", Gasification Technologies Conference, Washington, DC, Oct. 1-4, 2006.

Pinkton, T., et al., "Orlando Gasification Project: Demonstration of a 285 MW Coal-Based Transport Gasifier", The 31st International Technical Conference on Coal Utilization and Fuel Systems, Clearwater, Florida, May 21-25, 2006.

Breton, D., "Improved Performance of the "DESTEC" Gasifier," The 1999 Gasification Technologies Conference, Washington, DC.

"Clean Coal Today", Newsletter, 39 Issue No. 39, Spring 2000, Office of Fossil Energy, U.S. Department of Energy, Washington, DC.

Maurstad, Ola " An Overview of Coal based Integrated Gasification Combined Cycle (IGCC)Technology," Massachusetts Institute for Technology—Laboratory for Energy and the Environment, Sep. 2005, MIT LFEE 2005-002 WP, pp. 1-36.

"PERP 03/04S11, "Coal Gasification Technologies, Nexant Chem Systems, Jan. 2005, pp. 1-46.

Agarwal, A.T., "Improving Rotary Valve Performance," Chemical Eng., Mar. 2005, p. 29-33.

Barker, et al., "Pressure feeder for powered coal or other finely divided solids," I & EC, 43(5), p. 1204-1209. May 1951.

Alessi, P., et al., "Particle production of steroid drugs using supercritical fluid processing," I&EC Res., 35(12), p. 4718-4726. 1996.

"Coal: American's Energy Future, vol. II: A Technical Overview," Report of the National Coal Council, Mar. 2006.

Holt, N, "Gasification Process Selection—Trade-offs and Ironies," Electronic Power Research Institute ,Gasification Technologies Conference, Washington DC, Oct. 4-6, 2004.

* cited by examiner

SYSTEMS AND METHODS FOR GASIFYING A FEEDSTOCK

BACKGROUND

1. Field

Embodiments described herein generally relate to the gasification of hydrocarbons. More particularly, such embodiments relate to operating a gasifier.

2. Description of the Related Art

Gasification is a high-temperature process usually conducted at elevated pressure that converts carbon-containing material into mostly gaseous mixtures, including carbon dioxide, carbon monoxide, hydrogen, and methane. These gaseous mixtures are typically referred to as synthesis gas or, more succinctly, syngas. Upon production, syngas can be used as a feedstock to generate electricity and/or steam, a source of hydrogen, and for the production of other organic chemicals. Thus, gasification adds value to low-value feedstocks by converting them to marketable products. Coal, crude oil, coke, and high-sulfur residues have been used as gasification feedstock. The gasification feedstock is typically reacted in a gasifier (i.e. reactor) with an oxidizing medium in a reducing (stoichiometrically oxygen-starved) atmosphere at a high temperature and (usually) high pressure.

In certain gasifiers, fluidized solids are circulated through various sections of the gasifier. Problems, however, can be encountered when attempting to maintain an optimum solids circulation rate to provide for effective functioning of the gasifier. In certain gasifiers, particulates can be produced from the gasification of hydrocarbons. Problems can be encountered when attempting to maintain an optimum amount of particulates to provide for effective operation of the gasifier. Problems can also be encountered when attempting to maintain an optimum circulation rate of particulates to provide for effective operation of the gasifier.

There is a need, therefore, for more efficient systems and methods for the gasification of hydrocarbons.

DETAILED DESCRIPTION

Systems and methods for gasifying a feedstock are provided. The method can include combining one or more feedstocks and one or more solid components in a treatment zone to provide a treated feedstock. At least a portion of the treated feedstock can be introduced to a reaction zone of a gasifier. The one or more solid components can have an average density and an average cross-sectional size that adjusts at least one of an average density of solids within a solids bed of the gasifier and an average cross-sectional size of the solids within the solids bed of the gasifier.

Figure 1:
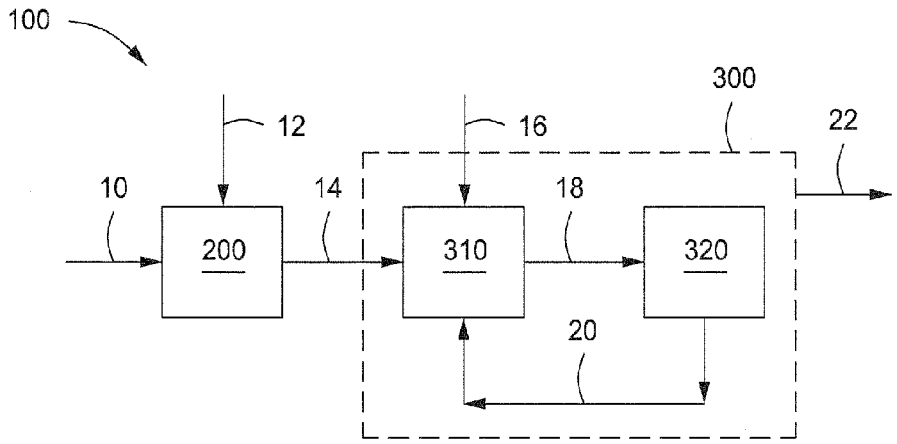
FIG. 1 depicts an illustrative system for treating and gasifying a feedstock, according to one or more embodiments described.

FIG. 1 depicts an illustrative system 100 for treating and gasifying one or more feedstocks in line 10, according to one or more embodiments. The system 100 can include one or more treatment systems or feedstock treating zones 200 and one or more gasifiers 300. One or more feedstocks via line 10 and one or more solid components via line 12 can be introduced to the treatment system 200 and mixed therein to provide a treated feedstock via line 14. The treated feedstock via line 14 can be introduced to the gasifier 300 to produce a raw syngas via line 22.

As used herein, the term "feedstock" refers to one or more raw materials, whether solid, liquid, gas, or any combination thereof. For example, the feedstock can include one or more carbonaceous materials. Examples of a suitable carbonaceous materials can include, but are not limited to, biomass (i.e., plant and/or animal matter or plant and/or animal derived matter); coal (high-sodium and low-sodium lignite, lignite, subbituminous, and/or anthracite, for example); oil shale; coke; tar; asphaltenes; low ash or no ash polymers; hydrocarbon-based polymeric materials; biomass derived material; or by-product derived from manufacturing operations. Examples of suitable hydrocarbon-based polymeric materials can include, but are not limited to, thermoplastics, elastomers, rubbers, including polypropylenes, polyethylenes, polystyrenes, including other polyolefins, homo polymers, copolymers, block copolymers, and blends thereof; PET (polyethylene terephthalate), poly blends, poly-hydrocarbons containing oxygen; heavy hydrocarbon sludge and bottoms products from petroleum refineries and petrochemical plants such as hydrocarbon waxes; blends thereof, derivatives thereof; and combinations thereof.

The feedstock in line 10 can include a mixture or combination of two or more carbonaceous materials (i.e., carbon-containing materials). The feedstock in line 10 can include a mixture or combination of two or more low ash or no ash polymers, biomass derived materials, or by-products derived from manufacturing operations. The feedstock in line 10 can include one or more carbonaceous materials combined with one or more discarded consumer products, for example, carpet and/or plastic automotive parts/components including bumpers and dashboards. Such discarded consumer products can preferably be reduced in size to fit within a gasifier 300. The feedstock 10 can include one or more recycled plastics, for example, polypropylene, polyethylene, polystyrene, derivatives thereof, blends thereof, or any combination thereof. Accordingly, the systems and methods discussed and described herein can be useful for accommodating mandates for proper disposal of previously manufactured materials.

The treated feedstock via line 14 can be dry fed or conveyed to the gasifier 300 as a slurry or suspension. The treated feedstock in line 14 can be dried, for example to 18% moisture, and then pulverized by a milling unit, for example a bowl mill, prior to feeding to the gasifier 300. For example, the treated feedstock in line 14 can have an average particle size of from about 50 micrometers (μm) to about 500 μm, or from about 50 μm to about 400 μm. In another example, the average particle size of the treated feedstock in line 14 can range from about 150 μm to about 450 μm, or from about 250 μm to about 400 μm.

The one or more solid components in line 12 can include any solid component or combination of solid components that can facilitate or otherwise provide for control or adjustment of a density of one or more recycling or re-circulating particulates within the gasifier 300 and/or a solids bed within the gasifier 300. The solids bed can also be referred to as a particulate bed and/or an "ash bed." Illustrative solid components in line 12 can include, but are not limited to, sand, ceramic materials, furnace fly ash, sieved furnace fly ash, gasifier ash, sieved gasifier ash, crushed limestone, or any combination thereof. For example, the solid components in line 12 can include furnace fly ash, sieved gasifier ash, or a combination thereof. Also for example, the solid components in line 12 can include sieved furnace fly ash, crushed limestone, or a combination thereof. The gasifier ash and/or sieved gasifier ash can be an ash produced or otherwise recovered from a gasification process or any combination of gasification processes. The furnace fly ash and/or sieved furnace fly ash can be an ash produced or otherwise recovered from a combustion process or any combination of combustion processes. In one or more embodiments, the solid components in line 12 can be free from any intentionally added ash. In one or more embodiments, the solid components in line 12 can be inert or non-reactive materials. For example, the solid components in line 12 can be resistant to reaction, gasification, combustion, vaporization, decomposition, or otherwise alteration within the gasifier 300.

In one or more embodiments, the solid components in line 12 can also provide one or more additional benefits in addition to facilitating control of the density of the recycling particulates within the gasifier 300. For example, the solid components in line 12 can also facilitate control of a solids bed or particulate bed within a standpipe 324 (see FIG. 3) of the gasifier 300. In another example, the solid components in line 12 can absorb tar within the gasifier 300. The density of the particulate bed within the standpipe 324 can impact the circulation or recycle rate of the particulates through the gasifier. The density of the particulate bed within the standpipe 324 can be adjusted or controlled by changing the average particle size, particle density, particle shape, or any combination thereof. The solid components in line 12 can be in the form of beads, pellets, flakes, spheres, cubes, fibers, blocks, rods, filaments, randomly crushed or ground particles, or any combination thereof.

The solid components in line 12 can have any density suitable for facilitating or otherwise providing control of the recycling particulates within the gasifier 300. The average density of the solid components in line 12 can range from about 2 g/cm$^3$ to about 5 g/cm$^3$. For example, the average density of the solid components in line 12 can range from a low of about 2 g/cm$^3$, about 2.5 g/cm$^3$, or about 3 g/cm$^3$ to a high of about 4 g/cm$^3$, about 4.5 g/cm$^3$, or about 5 g/cm$^3$.

The solid components in line 12 can have any cross-sectional size suitable for facilitating or otherwise providing control of the recycling particulates within the gasifier 300. The average cross-sectional size of the solid components in line 12 can range from about 30 μm to about 800 μm. For example, the average cross-sectional size of the solid components in line 12 can range from a low of about 30 μm, about 50 μm, or about 100 μm to a high of about 400 μm, about 500 μm, or about 600 μm.

As mentioned above, the treated feedstock via line 14 can be introduced to the gasifier 300 to produce the raw syngas via line 22. In one or more embodiments, one or more oxidants via line 16 can also be introduced to gasifier 300 to produce the raw syngas via line 22. The particular type and/or amount of oxidant introduced via line 16 to the gasifier 300 can influence the composition and/or physical properties of the syngas and hence, the downstream products made therefrom. Illustrative oxidants can include, but are not limited to, air, oxygen, essentially oxygen, oxygen-enriched air, mixtures of oxygen and air, mixtures of oxygen and one or more other gases such as syngas, mixtures of oxygen and one or more inert gases, for example, nitrogen and/or argon. The oxidant in line 16 can contain about 65 vol % oxygen or more, or about 70 vol % oxygen or more, or about 75 vol % oxygen or more, or about 80 vol % oxygen or more, or about 85 vol % oxygen or more, or about 90 vol % oxygen or more, or about 95 vol % oxygen or more, or about 99 vol % volume oxygen or more. As used herein, the term "essentially oxygen" refers to an oxygen stream containing more than 50 vol % oxygen. As used herein, the term "oxygen-enriched air" refers to a gas mixture containing about 21 vol % oxygen to 50 vol %. Oxygen-enriched air and/or essentially oxygen can be obtained, for example, from cryogenic distillation of air, pressure swing adsorption, membrane separation, or any combination thereof. The oxidant in line 16 can be nitrogen-free or essentially nitrogen-free. As used herein, the term "essentially nitrogen-free" refers to an oxidant in line 16 that contains about 5 vol % nitrogen or less, about 4 vol % nitrogen or less, about 3 vol % nitrogen or less, about 2 vol % nitrogen or less, or about 1 vol % nitrogen or less.

The raw syngas in line 22 can contain about 85 vol % or more carbon monoxide and hydrogen with the balance being primarily carbon dioxide and methane. The raw syngas in line 22 can contain about 90 vol % or more carbon monoxide and hydrogen, about 95 vol % or more carbon monoxide and hydrogen, about 97 vol % or more carbon monoxide and hydrogen, or about 99 vol % or more carbon monoxide and hydrogen. The carbon monoxide content of the raw syngas in line 22 can range from a low of about 10 vol %, about 20 vol %, or about 30 vol % to a high of about 50 vol %, about 70 vol %, or about 85 vol %. The carbon monoxide content of the raw syngas in line 22 can range from a low of about 15 vol %, about 25 vol %, or about 35 vol % to a high of about 65 vol %, about 75 vol %, or about 85 vol %. The hydrogen content of the raw syngas in line 22 can range from a low of about 1 vol %, about 5 vol %, or about 10 vol % to a high of about 30 vol %, about 40 vol %, or about 50 vol %. For example, the hydrogen content of raw syngas in line 22 can range from about 20 vol % to about 30 vol %.

The raw syngas in line 22 can contain less than about 25 vol %, less than about 20 vol %, less than about 15 vol %, less than about 10 vol %, or less than about 5 vol % of combined nitrogen, methane, carbon dioxide, water, hydrogen sulfide, and hydrogen chloride. The carbon dioxide content of the raw syngas in line 22 can be about 25 vol % or less, about 20 vol % or less, about 15 vol % or less, about 10 vol % or less, about 5 vol % or less, about 3 vol % or less, about 2 vol % or less, or about 1 vol % or less. The methane content of the raw syngas in line 22 can be about 15 vol % or less, about 10 vol % or less, about 5 vol % or less, about 3 vol % or less, about 2 vol % or less, or about 1 vol % or less. The water content of the raw syngas in line 22 can be about 40 vol % or less, about 30 vol % or less, about 25 vol % or less, about 20 vol % or less, about 15 vol % or less, about 10 vol % or less, about 5 vol % or less, about 3 vol % or less, about 2 vol % or less, or about 1 vol % or less. The raw syngas in line 22 can be nitrogen-free or essentially nitrogen-free. For example, the raw syngas in line 22 can contain less than about 3 vol %, less than about 2 vol %, less than about 1 vol %, or less than about 0.5 vol % nitrogen.

The raw syngas in line 22 can have a heating value, corrected for heat losses and dilution effects, of about 1863 kJ/m$^3$ (50 Btu/scf) to about 2794 kJ/m$^3$ (75 Btu/scf), about 1863 kJ/m$^3$ (50 Btu/scf) to about 3726 kJ/m$^3$ (100 Btu/scf), about 1863 kJ/m$^3$ (50 Btu/set) to about 4098 kJ/m$^3$ (110 Btu/scf), about 1863 kJ/m$^3$ (50 Btu/set) to about 5516 kJ/m$^3$ (140 Btu/scf), about 1863 kJ/m$^3$ (50 Btu/scf) to about 6707 kJ/m$^3$ (180 Btu/set), about 1863 kJ/m$^3$ (50 Btu/scf) to about 7452 kJ/m$^3$ (200 Btu/scf), about 1863 kJ/m$^3$ (50 Btu/scf) to about 9315 kJ/m$^3$ (250 Btu/scf), or about 1863 kJ/m$^3$ (50 Btu/scf) to about 10264 kJ/m$^3$ (275 Btu/scf), about 1,863 kJ/m$^3$ (50 Btu/scf) to about 11,178 kJ/m$^3$ (300 au/set), about 1,863 kJ/m$^3$ (50 Btu/scf) to about 13,041 kJ/m$^3$ (350 Btu/scf), or about 1,863 kJ/m$^3$ (50 Btu/scf) to about 14,904 kJ/m$^3$ (400 Btu/scf).

Still referring to FIG. 1, in one or more embodiments, at least a portion of the treated feedstock via line 14 can be introduced to one or more reaction zones 310 of the gasifier 300, and one or more oxidants via line 16 can also be introduced to the reaction zone 310. The treated feedstock introduced via line 14 and the one or more oxidants introduced via line 16 can be mixed or otherwise contacted within the reaction zone 310 and reacted therein to provide a raw syngas/particulate mixture. At least a portion of the raw syngas/particulate mixture via line 18 can be introduced to one or more separation zones 320 of the gasifier 300 to provide one or more separated particulates via line 20 and the raw syngas via line 22. At least a portion of the separated particulates via line 20 can be recycled or re-circulated to the reaction zone 310.

In one or more embodiments, the oxidant introduced via line 16 to the reaction zone 310 can be less than about five percent of the stoichiometric amount of oxidant required for complete combustion of all the carbon introduced to the reaction zone 310. In one or more embodiments, a molar ratio of oxygen to carbon coated on the recycled particulates can be maintained at a sub-stoichiometric proportion to promote the formation of carbon monoxide over carbon dioxide within the reaction zone 310.

The recycled particulates via line 20 can include any component that can be produced from the gasification of the feedstock within the reaction zone 310, at least portion of the solid components introduced via line 12 to the treatment system 200, or any combination thereof. For example, the recycled particulates via line 20 can include carbon coated or "coked" particulates. The coke can be deposited on the particulates within the reaction zone 310 when the feedstock is at least partially combusted, vaporized, cracked, and/or gasified therein. The recycled particulates via line 20 can also include ash or char produced within the reaction zone 310 when the feedstock is at least partially combusted, vaporized, cracked, gasified, and/or deposited onto the recycled particulates.

In one or more embodiments, the introduction of the one or more solid components via line 12 can modify the average density and/or average cross-sectional size of the recycled particulates in line 20. For example, if the recycled or re-circulated particulates in line 20 have a first average density, the first average density can be increased by introducing solid components via line 12 to the treatment system 200 that have a greater average density than the first average density. In another example, if the recycled or re-circulated particulates in line 20 have a first average density, the first average density can be decreased by introducing solid components via line 12 to the treatment system 200 that have a lower average density than the first average density. In another example, if the recycled or re-circulated particulates in line 20 have a first average cross-sectional size, the first average cross-sectional size can be increased by introducing solid components via line 12 to the treatment system 200 that have a greater average cross-sectional size than the first average cross-sectional size. In another example, if the recycled or re-circulated particulates in line 20 have a first average cross-sectional size, the first average cross-sectional size can be decreased by introducing solid components via line 12 to the treatment system 200 that have a lower average cross-sectional size than the first average cross-sectional size. By controlling or adjusting the average density and/or average cross-sectional size of the solid components introduced via line 12 to the treatment system 200, introduction of the treated feedstock stream via line 14 can control or adjust the average density and/or average cross sectional size of the recycled particulates in line 20.

The average density of the recycled particulates can be controlled and/or adjusted to provide recycled particulates via line 20 having an average density ranging from about 2 $g/cm^3$ to about 5 $g/cm^3$. The average cross-sectional size of the recycled particulates can be controlled or adjusted to provide recycled particulates via line 20 having an average cross-sectional size ranging from about 20 μm to about 800 μm.

The average density and/or average cross-sectional size of the recycled particulates via line 20 can widely vary. The variation of the average density and/or average cross-sectional size of the recycled particulates can affect one or more operating parameters of the gasifier including, but not limited to, operating parameters that can be used to adjust the quantity of solids in the gasifier 300, for example, to adjust a solids bed height and/or solids bed density in the standpipe (see FIG. 3, standpipe 324). Adjusting or controlling the solid components introduced via line 12 to the treatment system 200 can be used to control or adjust one or more operating parameters.

By controlling the density of the recycled particulates in line 20, the effectiveness and/or production capacity of the gasifier 300 can be improved. For example, by controlling the average density of the recycled particulates in line 20, the average density of the solids in the riser zone can be optimized to enable the gasifier to operate with a broad range of properties of the solids and particulates circulating through the gasifier. For example, the effectiveness and capacity of gasifier 300 can be improved when the properties of the recycled particulates in line 20 differ from the design parameters of the gasifier 300 because the solid components introduced via line 12 to the treatment system 200 can control or adjust the bed density and/or bed height in the standpipe of the gasifier 300. The particulate bed density and/or height of the particulate bed within the standpipe can be used to control the circulation rate and/or residence time of the feedstock within the gasifier 300, for example.

Figure 2:
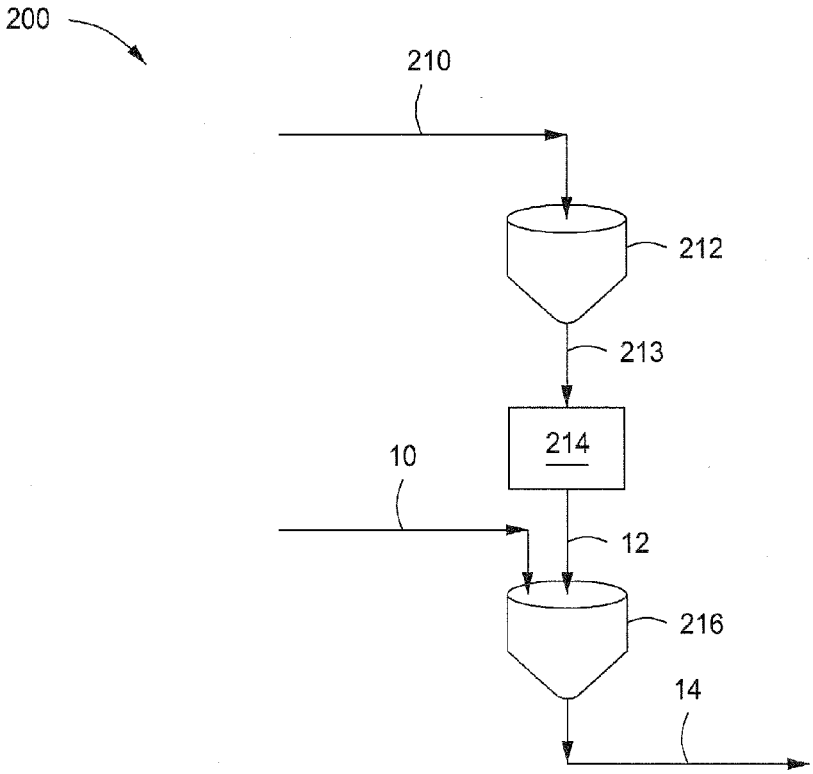
FIG. 2 depicts an illustrative system for treating a feedstock, according to one or more embodiments described.

FIG. 2 depicts an illustrative treatment system 200 for treating one or more feedstocks, according to one or more embodiments. The system 200 can include one or more solid component vessels 212 and one or more treated feedstock vessels 216. One or more solids via line 210 can be introduced to the solid components vessel 212. The solid components vessel 212 can be any vessel that can provide for holding of the one or more solids introduced via line 210 thereto. Illustrative solid components vessel 212 can include, but are not limited to, tanks and lock hoppers. While one source or supply of the solids via line 210 is shown, it should be understood that there can be several sources or supplies of the solids that can be introduced to the solid components vessel 212 to provide for various different solids in the treated feedstock vessel 216.

The system 200 can also include one or more feeding systems 214 that can be used to produce or otherwise provide the solid components via line 12. For example, the solids via line 213 can be introduced from the solid components vessel 212 to the feeding system 214. The feeding system 214 can include any feeding system that can provide for the introduction of the solid components via line 12 to the treated feedstock vessel 216 for mixing with the feedstock introduced via line 10. Illustrative feeding systems 214 can include, but are not limited to, belt-driven feed systems and metering systems. Illustrative treated feedstock vessels 216 can include, but are not limited to, tanks and lock hoppers. The solid components vessel 212 and treated feedstock vessel 216 can include means for contacting components in the vessels, for example, mixers, blenders, grinders, mills, or any combination thereof. The treated feedstock via line 14 can be passed from the treated feedstock vessel 216 to the gasifier 300 (see FIG. 1). Flow control valves (not shown) can be utilized to assist in the flow of the solid components, feedstock, and/or treated feedstock. Examples of suitable flow control valves include, but are not limited to, rotary valves, rotating disc valves, or any combination thereof.

Figure 3:
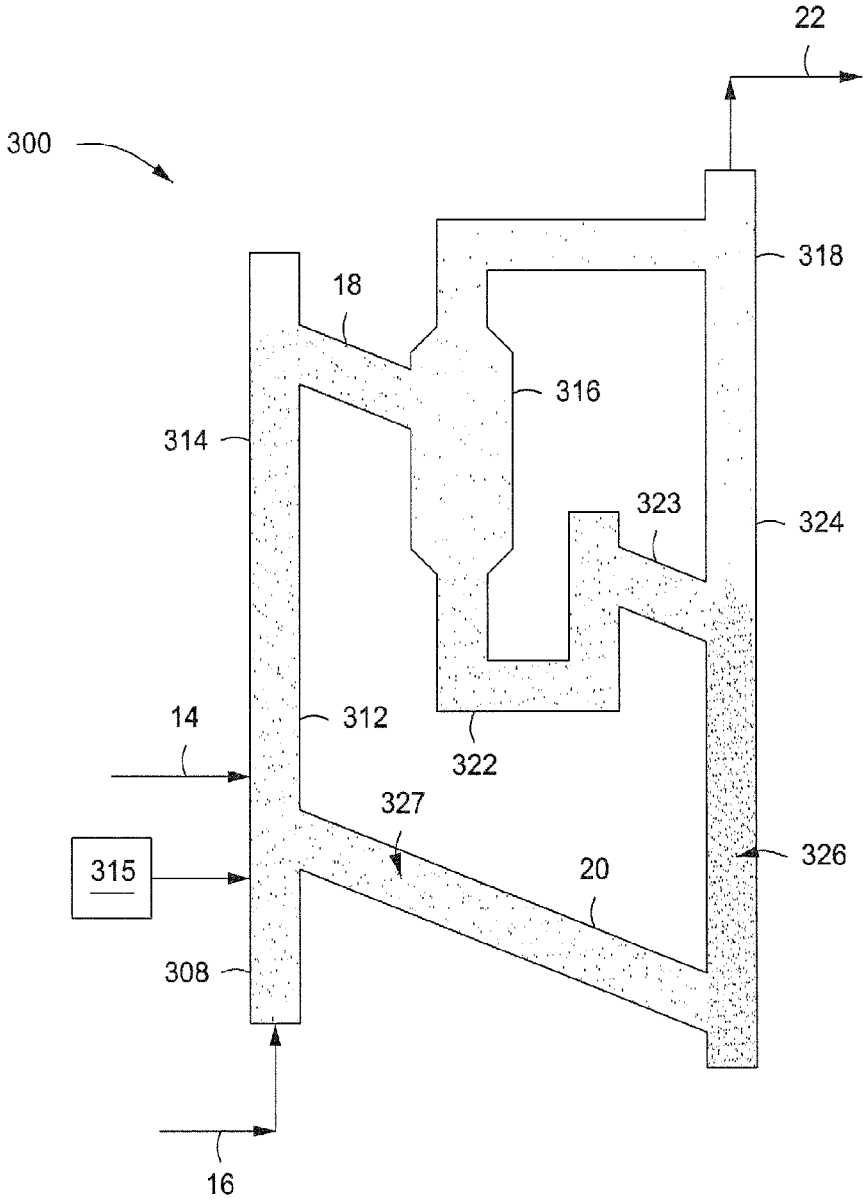
FIG. 3 depicts an illustrative gasifier, according to one or more embodiments described.

FIG. 3 depicts an illustrative gasifier 300, according to one or more embodiments. The gasifier 300 can include a single reactor unit or two or more reactor units arranged in series or parallel. Each gasifier 300 can include one or more first mixing zones 308, one or more second mixing zones 312, and one or more gasification zones 314. It should be noted that the mixing zone 310 depicted in FIG. 1 and discussed and described above with reference thereto, can include the first mixing zone 308, second mixing zone 312, and gasification zone 314. As such, the treated feedstock via line 14 can be introduced to the first mixing zone 308, second mixing zone 312, and/or the gasification zone 314. The gasifier 300 can also include one or more first or primary disengagers 316 and one or more secondary disengagers 318. It should also be noted that the separation zone 320 depicted in FIG. 1 and discussed and described above with reference thereto, can include the primary disengager 316 and the secondary disengager 318. As such the raw syngas/particulate mixture via line 18 can be introduced to the first disengager 316 and then to the second disengager 318. Each gasifier can be configured independent from one another or configured where any of the first mixing zones 308, second mixing zones 312, gasification zones 314, first disengager 316, and/or second disengager 318 can be shared. For simplicity and ease of description, embodiments of gasifier 300 will be further described in the context of a single reactor unit.

The oxidant via line 16 can be introduced to the first mixing zone 308 as shown. In another example, the oxidant via line 16 can be introduced to the second mixing zone 312. In still another example, the oxidant via line 16 can be introduced to both the first and second mixing zones 308, 312. The oxidant via line 16 can be introduced to the gasifier 300 at a rate suitable to control a temperature within the gasification zone 314. Excess oxygen and steam introduced with the oxidant and/or as a separate component can be consumed by the recycled particulates introduced via line 20 to gasifier 300 at a portion intermediate the first and second mixing zones 308, 312.

In one or more embodiments, an operating temperature within the gasification zone 314 operating at a pressure of about 500 pounds per square inch gauge (psig) to about 600 psig and about 1,800° F. can be increased by burning the carbon or coke contained on the recycled particulates via line 20. The treated feedstock via line 14 and an optional sorbent (not shown) can be introduced separately to the first mixing zone 308, the second mixing zone 312, and/or the gasification zone 314. The raw syngas/particulate mixture via line 18 can be recovered from the gasification zone 314 and introduced to the one or more disengagers 316, 318 to separate at least a portion of the particulates 327 from the syngas, with the raw syngas recovered via line 22 and the particulates 327 introduced to the standpipe 324. The gasification zone 314 can have a smaller diameter or cross-sectional area than the first and/or second mixing zones 308, 312.

The separated particulates 327 recovered from the first and second disengagers 316, 318, respectively can be recycled to first and/or second mixing zones 308, 312 via one or more loopseals 322, transfer lines 323, standpipes 324, j-legs or "recycle lines" 20, or any combination thereof. The recycle line 20 can include one or more nonmechanical "j-valves," "y-valves," "L-valves," or any combination thereof. Recycling the separated particulates 327 can increase the effective solids residence time, increase the amount of carbon converted to syngas within the gasification zone 314, reduce aeration requirements for recycling the particulates to the first and/or second mixing zones 308, 312, and/or can improve sorbent utilization. The disengagers 316 and 318 can be cyclones. The loopseal 322 and/or any other suitable particulate transfer device can be located downstream of disengagers 316 and/or 318 to collect separated particulate fines. Entrained or residual particulates in the raw syngas via line 22 can be removed using one or more particulate removal systems 414 (see FIG. 4).

Considering the reaction zone 310 of the gasifier 300 (i.e., first mixing zone 308, second mixing zone 312, and gasification zone 314) in more detail, at least a portion of the carbon or coke on the recycled particulates 327 introduced via line 20 can be combusted within the second mixing zone 312 to generate heat within the gasifier 300. The heat produced by combusting the carbon contained on the solids or recycled particulates 327 can be used for gasifying the treated feedstock introduced via line 14. The treated feedstock in line 14 along with the solids and heat produced by combusting at least a portion of the carbon on the solids can enter the gasification zone 314 where additional residence time allows char gasification, methane/steam reforming, tar cracking, water-gas shift reactions, and/or sulfur capture reactions to occur. Generally, the residence time and temperature in gasifier 300 should be sufficient for water-gas shift reaction to reach equilibrium. The residence time of the feedstock in the second mixing zone 312 can be about 1 second, about 2 seconds, about 5 seconds, about 10 seconds or more.

The gas velocity through the gasification zone 314 can range from about 3 meters per second (m/s) to about 28 m/s, from about 6 m/s to about 25 m/s, from about 9 m/s to about 22 m/s, from about 10 m/s to about 20 m/s, or from about 9 m/s to about 15 m/s. The residence time and high temperature conditions in gasification zone 314 can provide for a water-gas shift reaction to reach equilibrium. The gasification zone 314 can operate at a higher temperature than second mixing zone 312. Suitable temperatures in the gasification zone 314 can range from about 600° F. to about 2,000° F. The gasifier 300 can be operated in a temperature range sufficient to not melt the recycling particulates, for example ash.

In starting the gasifier 300, heat can be supplied by a startup burner 315. The startup burner 315 can at least partially combust a startup fuel and the combustion gas can be introduced to the second mixing zone 312, for example, and heat therefrom can heat the gasifier 300. For example, startup (i.e., prior to feeding treated feedstock via line 14 to the second mixing zone 312) can be commenced by bringing the second mixing zone 312 to a temperature ranging from about 950° F. to about 1,200° F. and optionally feeding coke breeze or the equivalent to mixing zone 312 to further increase the temperature of mixing zone 312 to about 1650° F.

The operating temperature of the first and/or second mixing zones 308, 312 can range from about 500° F., about 750° F., or about 1,000° F. to about 1,200° F., about 1,500° F., or about 1,900° F. For example, the operating temperature of the first and/or second mixing zones 308, 312 can range from about 700° F. to about 1,750° F., from about 900° F. to about 1,600° F., or from about 1,200° F. to about 1,600° F. The first and/or second mixing zones 308, 312 can be operated at pressures from about 0 pounds per square inch gauge (psig) to about 700 psig to increase thermal output per unit reactor cross-sectional area and enhance energy output in the subsequent power cycle. For example, the first and/or second mixing zones 308, 312 can be operated at pressures from about 100 psig to about 650 psig, from about 100 psig to about 600 psig, or from about 100 psig to about 550 psig.

The operating temperature of the gasifier 300 can be controlled by the recirculation rate of the recycling particulates, by the addition of steam to the first and/second mixing zones 308, 312 and/or the gasification zone 314, by the addition of the oxidant via line 16 to the first and/or second mixing zones 308, 312, and/or residence time of the feedstock and/or solids within first and/or second mixing zones 308, 312 and/or the gasification zone 314. Excess oxygen in the air can be consumed by the recycled particulates 327 via line 20 forming primarily carbon dioxide, thereby minimizing tar formation and stabilizing the gasifier temperature during operation and periods of feed interruption. The recycled particulates 327 can also serve to rapidly heat the incoming treated feedstock introduced via line 14 and minimize tar formation. The oxidant via line 16 can be introduced to the first mixing zone 308 to increase the temperature within second mixing zone 312 and gasification zone 314 by combusting at least portion of the carbon contained on the recycled particulates 327 introduced via line 20.

The treated feedstock via line 14 and oxidant via line 16 can be injected separately, as shown, to the gasifier 300 and/or introduced as a mixture (not shown). The treated feedstock via line 14 and oxidant via line 16 can be injected sequentially into the gasifier 300. The treated feedstock via line 14 and oxidant via line 16 can be injected simultaneously into the gasifier 300.

Similarly as described above with reference to FIG. 1, the average density and/or the average cross-sectional size of the recycled solids or particulates 327 via line 20 can be controlled by adjusting or controlling the type and/or amount of solid components contacted and mixed with the feedstock to provide treated feedstock via line 14.

The standpipe 324 can contain a bed of particulates or "solids bed" 326 therein. The particulates 327 separated from the raw syngas in the disengagers 316, 318 can be introduced to the solids bed 326 within standpipe 324 and during operation of the gasifier 300 the particulates 327 can be recycled via line 20 to the first mixing zone 308, second mixing zone 312, and/or the gasification zone 314. The height and/or density of the solids bed 326 within the standpipe 324 can influence the circulation rate of the recycled particulates 327 via line 20.

Referring to FIGS. 1-3, the introduction of the one or more solid components via line 12 to produce the treated feedstock via line 14 can modify the average density and/or average cross-sectional size of the recycled particulates within the gasifier 300 and the average density and/or average cross-sectional size of the particles in the solids bed 326. For example, if the particulates within the solids bed 326 of standpipe 324 have a first average density, the first average density can be increased by introducing solid components via line 12 to the treatment system 200 that have a greater average density than the first average density. In another example, if the particulates within the solids bed 326 of standpipe 324 have a first average density, the first average density can be decreased by introducing solid components via line 12 to the treatment system 200 that have a lower density than the first average density. In another example, if the particulates within the solids bed 326 of standpipe 324 have a first average cross-sectional size, the first average cross-sectional size can be increased by introducing solid components via line 12 to the treatment system 200 that have a greater average cross-sectional size than the first average cross-sectional size. In another example, if the particulates within the solids bed 326 of standpipe 324 have a first average cross-sectional size, the first average cross-sectional size can be decreased by introducing solid components via line 12 to the treatment system 200 that have a lower average cross-sectional size than the first average cross-sectional size. By controlling or adjusting the average density and/or average cross-sectional size of the solid components introduced via line 12 to the treatment system 200, introduction of the treated feedstock stream via line 14 can control or adjust the average density and/or average cross-sectional size of the particulates within the solids bed 326 of standpipe 324, the recycled particulates 327 via line 20, and throughout the gasifier 300.

The average density of the solid components via line 12 can be controlled or adjusted to provide particulates within the solids bed 326 of the standpipe 324 having an average density ranging from about 2 g/cm$^3$ to about 5 g/cm$^3$. The average cross-sectional size of the solid components via line 12 can be controlled or adjusted to provide particulates within the solids bed 326 of standpipe 324 having an average cross-sectional size ranging from about 20 μm to about 800 μm.

In one or more embodiments, the amount of raw syngas produced via line 22 from the gasifier 300 operating at a particular set of operating conditions, e.g., temperature, pressure, feedstock residence time, recycle rate of the recycled particulates via line 20, solids bed 326 density within standpipe 324, and the like, can be increased by the addition of solid components via line 12 having an average density and/or average cross-sectional area suitable for adjusting the average density and/or average cross-sectional size of the particulates in the solids bed of standpipe 324. By optimizing the average density and/or average cross-sectional size of the particulates in the solids bed 326 of standpipe 324, the circulation rate of the recycled particulates via line 20 can be improved such that the amount of syngas produced from a given amount of feedstock increases. Controlling or adjusting the average density and/or average cross-sectional size of the particulates in the solids bed 326 of standpipe 324 can also improve the ability of the gasifier 300 to accommodate a wider range of particular feedstocks via line 10. For example, the feedstock via line 10 could initially be a coal derived from a first source that has a first set of properties and during operation the feedstock via line 10 can be changed to another coal from a second source that has a second set of properties. Controlling the average density and/or average cross-sectional size of the particulates in the solids bed 326 of standpipe 324 can increase the ability of the gasifier 300 to efficiently gasify feedstocks via line 10 having a wider range of properties.

One or more sorbents (not shown) can be introduced to the gasifier 300. The sorbent can be added to capture contaminants from the gas, such as sodium vapor in the gas phase, within the gasifier 300. The sorbent can be used to dust or coat feedstock and/or ash particles in gasifier 300 to reduce the tendency for the particles to agglomerate. The treated feedstock via line 14 and the sorbent can be mixed and fed together, or fed separately, to the gasifier. The treated feedstock via line 14, oxidant via line 16, and the optional sorbent can be injected sequentially or simultaneously. The sorbents can be ground to an average particle size of about 5 μm to about 100 μm, or about 10 μm to about 75 Examples of suitable sorbents include, but are not limited to, limestone, dolomite, and coke breeze.

Figure 4:
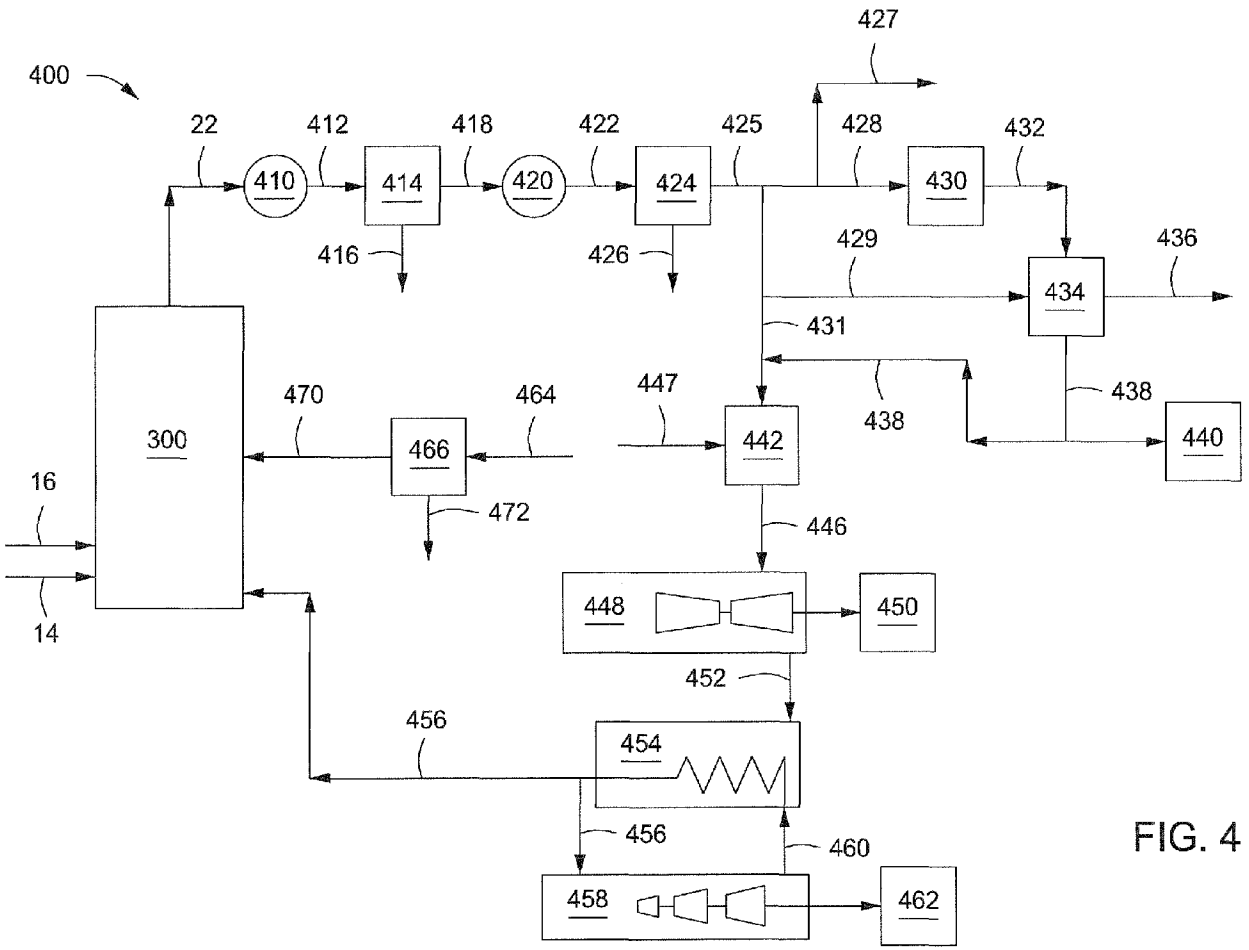
FIG. 4 depicts an illustrative gasification system, according to one or more embodiments described.

FIG. 4 depicts an illustrative gasification system 400, according to one or more embodiments. The gasification system 400 can include one or more gasifiers 300, particulate removal systems 414, and gas purification systems 424 to produce a treated synthesis gas ("syngas") via line 425 that includes about 85% or more of combined carbon monoxide and hydrogen with the balance being primarily carbon dioxide and methane. The gasification system 400 can also include one or more gas converters 430 to produce a Fischer-Tropsch product, chemical, and/or feedstock, derivatives thereof, and/or combinations thereof, including ammonia and methanol. The gasification system 400 can also include one or more hydrogen separators 434, fuel cells 440, combustors 442, gas turbines 448, steam turbines 458, waste heat boilers 454, and generators (two are shown 450 and 462) to produce fuel, power, steam and/or energy. The gasification system 400 can also include one or more air separation units ("ASU") 466 for the production of essentially nitrogen-free synthesis gas.

The particulate removal system 414 can be used to partially or completely remove any particulates from raw syngas via line 22 to provide particulates via line 416 and a separated syngas via line 418. The raw syngas via line 22 can be cooled using a cooler 410 ("primary cooler") to provide a cooled raw syngas via line 412 prior to introduction to the particulate removal system 414. For example, the raw syngas via line 22 can be cooled to about 1,000° F. or less, about 900° F. or less, about 800° F. or less, about 700° F. or less, about 600° F. or less, about 500° F. or less, about 400° F. or less, or about 300° F. or less. Cooling the raw syngas in line 22 prior to particulate removal system 414 is optional. For example, the raw syngas via line 22 can be introduced directly to the particulate removal system 414, resulting in hot gas particulate removal (for example at a temperature of about 1,050° F. to about 1,900° F.).

The particulate removal system 414 can include one or more separation devices, for example conventional disengagers and/or cyclones (not shown). Particulate control devices ("PCD") capable of providing an outlet particulate concentration below the detectable limit of about 0.1 parts per million by weight (ppmw) can also be used. Examples of suitable illustrative PCDs include, but are not limited to, sintered metal filters, metal filter candles, and/or ceramic filter candles (for example, iron aluminide filter material).

The solid particulates via line 416 can be recycled (not shown) to the gasifier 300 or purged from the system, as shown. The separated syngas via line 418 can be cooled using one or more coolers 420 ("secondary cooler") to provide a cooled, separated syngas via line 422. The cooled, separated syngas via line 422 can have a temperature of about 650° F. or less, for example about 300° F. to about 550° F. The cooled, separated syngas via line 422 can be treated within the gas purification system 424 to remove contaminants and to provide a waste gas via line 426 and the treated syngas via line 425. The gas purification system 424 can include any system, process, and/or device, or any combination thereof, capable of removing at least a portion of any sulfur and/or sulfur-containing compounds contained in the cooled, separated syngas in line 422. For example, the gas purification system 424 can include a catalytic gas purification system that can include, but is not limited to, catalytic systems using zinc titanate, zinc ferrite, tin oxide, zinc oxide, iron oxide, copper oxide, cerium oxide, or mixtures thereof. In another example, the gas purification system 424 can include a process-based gas purification system that can include, but is not limited to, the Selexol™ process, the Rectisol® process, the Crysta-Sulf® process, and the Sulfinol® Gas Treatment Process.

An amine solvent such as methyl-diethanolamine (MDEA) can be used to remove acid gas from cooled, separated syngas via line 422. Physical solvents, for example Selexol™ (dimethyl ethers of polyethylene glycol) or Rectisol® (cold methanol), can also be used. If cooled, separated syngas via line 422 contains carbonyl sulfide (COS), the carbonyl sulfide can be converted by hydrolysis to hydrogen sulfide by reaction with water over a catalyst and then absorbed using the methods described above. If cooled, separated syngas via line 422 contains mercury, the mercury can be removed using a bed of sulfur-impregnated activated carbon.

A cobalt-molybdenum ("Co—Mo") catalyst can be incorporated into the gas purification system 424 to perform a sour shift conversion of the syngas. The Co—Mo catalyst can operate at a temperature of about 550° F. in presence of $H_2S$, for example, about 100 ppmw $H_2S$. If a Co—Mo catalyst is used to perform a sour shift, subsequent downstream removal of sulfur can be accomplished using any of the above described sulfur removal methods and/or techniques.

In one or more embodiments, at least a portion of the treated syngas in line 425 recovered from the gas purification system 424 can be introduced via line 431 along with one or more oxidants via line 447 to the combustor 442 and combusted to produce or generate power and/or steam. In one or more embodiments, at least a portion of the treated syngas in line 425 can be removed from the system via line 427 and sold as a commodity. In one or more embodiments, at least a portion of the treated syngas in line 425 can be introduced via line 428 to the one or more gas converters 430 and used to produce Fischer-Tropsch products, chemicals, and/or feedstocks. Hydrogen can be separated from the treated syngas via line 425 and used in hydrogenation processes, fuel cell energy processes, ammonia production, and/or as a fuel. Carbon monoxide can be separated from treated syngas via line 425 and used for the production of chemicals, for example, acetic acid, phosgene/isocyanates, formic acid, and propionic acid.

Still referring to FIG. 4, the gas converter 430 can be used to convert the treated syngas introduced via line 428 thereto into one or more Fischer-Tropsch products, chemicals, and/or feedstocks via line 432 ("converted gas via line 432"). Gas converter 430 can include a shift reactor to adjust the hydrogen to carbon monoxide ratio ($H_2$:CO) of the synthesis gas by converting CO to $CO_2$. Within the shift reactor, a water-gas shift reaction can react at least a portion of the carbon monoxide in the treated syngas via line 428 with water in the presence of a catalyst and a high temperature to produce hydrogen and carbon dioxide. Examples of suitable shift reactors can include, but are not limited to, single stage adiabatic fixed bed reactors, multiple-stage adiabatic fixed bed reactors with interstage cooling, steam generation or cold quench reactors, tubular fixed bed reactors with steam generation or cooling, fluidized bed reactors, or any combination thereof. A sorption enhanced water-gas shift (SEWGS) process, utilizing a pressure swing adsorption unit having multiple fixed bed reactors packed with shift catalyst and at high temperature, e.g. a carbon dioxide adsorbent at about 480° C., can be used. Various shift catalysts can be employed.

The shift reactor can include two reactors arranged in series. A first reactor can be operated at high temperature (about 650° F. to about 750° F.) to convert a majority of the CO present in treated syngas via line 428 to $CO_2$ at a relatively high reaction rate using an iron-chrome catalyst. A second reactor can be operated at a relatively low temperature (about 300° F. to about 400° F.) to complete the conversion of CO to $CO_2$ using a mixture of copper oxide and zinc oxide.

The recovered carbon dioxide from shift reactor 430 can be used in a fuel recovery process to enhance the recovery of oil and gas. In an illustrative oil recovery process, carbon dioxide can be injected and flushed into an area beneath an existing well where "stranded" oil exists. The water and carbon dioxide removed with the crude oil can then be separated and recycled.

The gas converter 430 can be used to produce one or more Fischer-Tropsch ("F-T") products, including refinery/petrochemical feedstocks, transportation fuels, synthetic crude oil, liquid fuels, lubricants, alpha olefins, and waxes. The reaction can be carried out in any type reactor, for example, fixed bed, moving bed, fluidized bed, slurry, or bubbling bed using copper, ruthenium, iron or cobalt based catalysts, or combination thereof, under conditions ranging from about 190° C. to about 450° C. depending on the reactor configuration.

The F-T products are liquids which can be shipped to a refinery site for further chemically reacting and upgrading to a variety of products. Certain products, for example C4-C5 hydrocarbons, can be high quality paraffin solvents which, if desired, can be hydrotreated to remove olefin impurities, or employed without hydrotreating to produce a wide variety of wax products. C16+ liquid hydrocarbon products can be upgraded by various hydroconversion reactions, for example, hydrocracking, hydroisomerization catalytic dewaxing, isodewaxing, or combinations thereof, to produce mid-distillates, diesel and jet fuels for example low freeze point jet fuel and high cetane jet fuel, isoparaffinic solvents, lubricants, for example, lube oil blending components and lube oil base stocks suitable for transportation vehicles, non-toxic drilling oils suitable for use in drilling muds, technical and medicinal grade white oil, chemical raw materials, and various specialty products.

The gas converter 430 can include a slurry bubble column reactor to produce an F-T product. The slurry bubble column reactor can operate at a temperature of less than about 220° C. and from about 10 to about 600 pounds per square inch absolute (psia), or about 250 to about 350 psia using a cobalt catalyst promoted with rhenium and supported on titania having a Re:Co weight ratio in the range of about 0.01 to about 1 and containing from about 2% wt to about 50% wt cobalt. The catalyst within the slurry bubble column reactor can include, but is not limited to, a titania support impregnated with a salt of a catalytic copper or an Iron Group metal, a polyol or polyhydric alcohol and, optionally, a rhenium compound or salt. Examples of suitable polyols or polyhydric alcohols include, but are not limited to, glycol, glycerol, derythritol, threitol, ribitol, arabinitol, xylitol, allitol, dulcitol, gluciotol, sorbitol, and mannitol. The catalytic metal, copper or Iron Group metal as a concentrated aqueous salt solution, for example cobalt nitrate or cobalt acetate, can be combined with the polyol and optionally perrhenic acid while adjusting the amount of water to obtain 15 wt % metal, for example, 15 wt % cobalt, in the solution and using optionally incipient wetness techniques to impregnate the catalyst onto rutile or anatase titania support, optionally spray-dried and calcined. This method reduces the need for rhenium promoter.

The gas converter 430 can be used to produce methanol, alkyl formates, dimethyl ether, ammonia, acetic anhydride, acetic acid, methyl acetate, acetate esters, vinyl acetate and polymers, ketenes, formaldehyde, dimethyl ether, olefins, derivatives thereof, and/or combinations thereof. For methanol production, for example, the Liquid Phase Methanol Process can be used (LPMeOH™). In this process, the carbon monoxide in the syngas via line 428 can be directly converted into methanol using a slurry bubble column reactor and catalyst in an inert hydrocarbon oil reaction medium which can conserve heat of reaction while idling during off-peak periods for a substantial amount of time while maintaining good catalyst activity. Gas phase processes for producing methanol can also be used. For example, known processes using copper-based catalysts can be used.

For ammonia production, gas converter 430 can be adapted to operate known processes to produce ammonia. For alkyl formate production, for example, methyl formate, any of several processes wherein carbon monoxide and methanol are reacted in either the liquid or gaseous phase in the presence of an alkaline catalyst or alkali or alkaline earth metal methoxide catalyst can be used.

Although not shown in FIG. 4, carbon dioxide can be separated and/or recovered from the converted gas via line 432. Physical adsorption techniques can be used. Examples of suitable adsorbents and techniques include, but are not limited to, propylene carbonate physical adsorbent solvent as well as other alkyl carbonates, dimethyl ethers of polyethylene glycol of two to twelve glycol units (Selexol™ process), n-methyl-pyrrolidone, sulfolane, and use of the Sulfinol® Gas Treatment Process.

In one or more embodiments, at least a portion of converted gas via line 432 can be sold or upgraded using further downstream processes not shown. In one or more embodiments, at least a portion of converted gas via line 432 can be directed to the hydrogen separator 434. In one or more embodiments, at least a portion of treated syngas in line 425 can bypass gas converter 430 described above, and can be introduced via line 429 directly to hydrogen separator 434. At least a portion of the treated syngas in line 428 can be removed via line 427 from the system 400 as a syngas product.

The one or more hydrogen separators 434 can include any system or device to selectively separate hydrogen from syngas to provide a purified hydrogen and a waste gas. The hydrogen separator 434 can provide a carbon dioxide rich fluid via line 436 and a hydrogen rich fluid via line 438. At least a portion of hydrogen rich fluid via line 438 can be used as a feed to a fuel cell 440 and at least a portion of hydrogen rich fluid via line 438 can be combined with treated syngas in line 431 prior to use as a fuel in the combustor 442. Hydrogen separator 434 can utilize pressure swing absorption, cryogenic distillation, and/or semi-permeable membranes. Examples of suitable absorbents include, but are not limited to, caustic soda, potassium carbonate or other inorganic bases, alkanes, and/or alkanolamines.

At least a portion of treated syngas via line 431 can be combusted in the combustor 442 in the presence of one or more oxidants introduced via line 447 thereto, to provide a high pressure/high temperature exhaust gas via line 446. The high pressure/high temperature exhaust gas via line 446 can be introduced to the gas turbine 448 to provide an exhaust gas via line 452 and mechanical shaft power to drive an electric generator 450. The exhaust gas via line 452 can be introduced to the waste heat boiler or heat recovery system 454 to provide steam via line 456. A first portion of the steam via line 456 can be introduced to a steam turbine 458 to provide mechanical shaft power to drive the generator 462. A second portion of the steam via line 456 can be introduced to gasifier 300, and/or other auxiliary process equipment. Lower pressure steam from steam turbine 458 can be recycled to heat recovery system 454 via line 460.

Essentially oxygen produced from the air separation unit ("ASU") 466 can be supplied to gasifier 300. ASU 466 can provide a nitrogen-lean and oxygen-rich fluid via line 470 to gasifier 300, thereby minimizing the nitrogen concentration in the system. The use of essentially oxygen allows gasifier 300 to produce raw syngas via line 22 that is essentially nitrogen-free, for example, containing less than 0.5% nitrogen/argon. ASU 466 can be a high-pressure, cryogenic type separator that can be supplemented with air via line 464. A reject nitrogen via line 472 from ASU 466 can be added to a combustion turbine or used as utility.

For example, up to about 50 vol % of the total oxidant fed to gasifier 300 can be supplied by ASU 466 via line 470, or up to about 40 vol % of the total oxidant fed to gasifier 300 can be supplied by ASU 466 via line 470, or up to about 30 vol % of the total oxidant fed to gasifier 300 can be supplied by ASU 466 via line 470, or up to about 20 vol % of the total oxidant fed to gasifier 300 can be supplied by ASU 466 via line 470, or up to about 10 vol % of the total oxidant fed to gasifier 300 can be supplied by ASU 466 via line 470.

Embodiments described herein further relate to any one or more of the following paragraphs:

1. A method for gasifying a feedstock, comprising: combining one or more feedstocks and one or more solid components in a treatment zone to provide a treated feedstock; and introducing at least a portion of the treated feedstock to a reaction zone of a gasifier, wherein the one or more solid components have an average density and an average cross-sectional size that adjusts at least one of an average density of solids within a solids bed of the gasifier and an average cross-sectional size of the solids within the solids bed of the gasifier.

2. The method of paragraph 1, wherein the average density of the one or more solid components ranges from about 2 $g/cm^3$ to about 5 $g/cm^3$.

3. The method of paragraph 1 or 2, wherein the average cross-sectional size of the one or more solid components ranges from about 20 μm to about 800 μm.

4. The method according to any one of paragraphs 1 to 3, wherein the average density of the solids within the solids bed of the gasifier ranges from about 3 $g/cm^3$ to about 4 $g/cm^3$.

5. The method according to any one of paragraphs 1 to 4, wherein the average cross-sectional size of the solids within the solids bed of the gasifier ranges from about 80 μm to about 100 μm.

6. The method according to any one of paragraphs 1 to 5, wherein the one or more solid components comprise sand, ceramic materials, furnace fly ash, sieved furnace fly ash, gasifier ash, sieved gasifier ash, crushed limestone, or any combination thereof.

7. The method according to any one of paragraphs 1 to 6, wherein the one or more solid components comprise sieved gasifier ash, crushed limestone, or a combination thereof.

8. The method according to any one of paragraphs 1 to 7, wherein the solids within the solids bed of the gasifier comprise ash.

9. The method according to any one of paragraphs 1 to 8, further comprising introducing one or more oxidants to the gasifier.

10. The method according to any one of paragraphs 1 to 9, wherein the reaction zone comprises one or more mixing zones and one or more gasification zones.

11. The method according to any one of paragraphs 1 to 10, wherein the one or more feedstocks comprise a coal based material selected from the group consisting of high-sodium lignite, low-sodium lignite, subbituminous coal, bituminous coal, and anthracite.

12. A method for gasifying a feedstock, comprising: mixing one or more feedstocks and one or more solid components to provide a treated feedstock; and introducing at least a portion of the treated feedstock to a reaction zone of a gasifier to produce a mixture comprising a raw syngas and one or more particulates; separating at least a portion of the one or more particulates from the mixture to produce separated particulates; introducing at least a portion of the separated particulates to a solids bed within the gasifier, wherein: the solids bed has a first average density, the one or more solid components have an average density ranging from about 2 $g/cm^3$ to about 5 $g/cm^3$, the one or more solid components have an average cross-sectional size ranging from about 20 μm to about 800 μm, introduction of the treated feedstock adjusts the first average density to a second average density, and the one or more solid components comprise sieved furnace fly ash, sieved gasifier ash, sand, crushed limestone, or any combination thereof.

13. The method of paragraph 12, wherein adjusting the first average density to the second average density increases the range of feedstocks that can be gasified within the gasifier.

14. The method of paragraph 12 or 13, further comprising recycling particulates from the solids bed within the gasifier to the reaction zone, wherein adjusting the first average density to the second average density adjusts a recycle rate of the particulates from the solids bed to the reaction zone.

15. The method according to any one of paragraphs 12 to 14, wherein the recycled particulates comprise ash.

16. The method according to any one of paragraphs 12 to 15, wherein mixing the one or more feedstocks and the one or more solid components occurs within a treated feedstock vessel.

17. The method according to any one of paragraphs 12 to 16, wherein the reaction zone comprises one or more mixing zones and one or more gasification zones.

18. A system for gasifying one or more feedstocks, comprising: a treatment zone comprising a solid component vessel, a feeding system, and a treated feedstock vessel, wherein the feeding system introduces one or more solid components from the solid component vessel to the treated feedstock vessel, and wherein the solid components are mixed with one or more feedstocks within the treated feedstock vessel to produce a treated feedstock; and a gasifier.

19. The system of paragraph 18, wherein the gasifier comprises one or more reaction zones and a solids bed.

20. The system of paragraph 19, wherein the treatment system produces a treated feedstock that adjusts an average density of the solids bed when introduced to the gasifier.

Certain embodiments and features have been described using a set of numerical upper limits and a set of numerical lower limits. It should be appreciated that ranges from any lower limit to any upper limit are contemplated unless otherwise indicated. Certain lower limits, upper limits, and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for gasifying a feedstock, comprising:

combining one or more feedstocks and one or more solid components in a treatment zone to provide a treated feedstock;

producing a raw syngas-particulate mixture by introducing at least a portion of the treated feedstock to a reaction zone of a gasifier;

producing one or more separated particulates by separating at least a portion of the raw syngas-particulate mixture in a separation zone of the gasifier;

recycling at least a portion of the one or more separated particulates into the reaction zone of the gasifier;

determining whether a property of the recycled one or more separated particulates differs from a design parameter of the gasifier;

if a difference in the property is determined, changing at least one of: (i) an average density of solids within a solids bed of the gasifier and (i) an average cross-sectional size of the solids within the solids bed of the gasifier by adjusting at least one of an average density and an average cross-sectional size of the one or more solid components being combined with the one or more feedstocks.

2. The method of claim 1, wherein the average density of the one or more solid components ranges from about 2 g/cm3 to about 5 g/cm3.

3. The method of claim 1, wherein the average cross-sectional size of the one or more solid components ranges from about 600 μm to about 800 μm.

4. The method of claim 1, wherein the average density of the solids within the solids bed of the gasifier ranges from about 3 g/cm3 to about 4 g/cm3.

5. The method of claim 1, wherein the average cross-sectional size of the solids within the solids bed of the gasifier ranges from about 500 μm to about 800 μm.

6. The method of claim 1, wherein the one or more solid components comprise ash, sand, ceramic materials, furnace fly ash, sieved furnace fly ash, gasifier ash, sieved gasifier ash, crushed limestone, or any combination thereof.

7. The method of claim 1, further comprising introducing one or more oxidants to the gasifier.

8. The method of claim 1, wherein the reaction zone comprises one or more mixing zones and one or more gasification zones.

9. The method of claim 1, wherein the one or more feedstocks comprise a coal based material selected from the group consisting of high-sodium lignite, low-sodium lignite, subbituminous coal, bituminous coal, and anthracite.

10. The method of claim 8, further comprising:

gasifying the treated feedstock to provide a mixture comprising syngas and particulates, wherein the particulates comprise solids produced by gasifying the treated feedstock;

separating the mixture into a first particulate-lean syngas and a first particulate-rich product;

separating the first particulate-lean syngas to provide a second particulate-lean syngas and a second particulate-rich product;

transferring the first particulate-rich product and the second particulate-rich product to the solids bed; and recycling the particulates from the solids bed to the reaction zone.

11. The method of claim 10, wherein the gasifier is operated at a temperature sufficient not to melt the solid components or the recycled particulates.

12. The method of claim 1, wherein the treated feedstock is heated by the recycled particulates in the reaction zone.

13. The method of claim 1, wherein the average density of the solids within the solids bed of the gasifier ranges from about 3 g/cm3 to about 4 g/cm3, wherein the average cross-sectional size of the one or more solid components ranges from about 20 μm to about 800 μm, and wherein the one or more solid components comprise sieved gasifier ash, crushed limestone, or a combination thereof.

14. The method of claim 1, further comprising changing a set of properties of the one or more feedstocks during operation of the gasifier and then increasing the efficiency of the gasifier by changing at least one of: (i) the average density of solids within the solids bed of the gasifier and (i) the average cross-sectional size of the solids within the solids bed of the gasifier.

15. The method of claim 14, wherein the set of properties of the one or more feedstocks is changed by changing a source of the feedstock.

* * * * *